US007152436B2

(12) United States Patent
Wang

(10) Patent No.: US 7,152,436 B2
(45) Date of Patent: Dec. 26, 2006

(54) CIRCULAR KNITTING MACHINE

(75) Inventor: Ping-Shih Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 423 days.

(21) Appl. No.: 10/759,427

(22) Filed: Jan. 20, 2004

(65) Prior Publication Data

US 2005/0155391 A1 Jul. 21, 2005

(51) Int. Cl.
*D04B 27/04* (2006.01)

(52) U.S. Cl. ..... 66/107

(58) Field of Classification Search ..... 66/107, 66/93, 141, 125 B

See application file for complete search history.

(56) References Cited

U.S. PATENT DOCUMENTS 2,775,109 A * 12/1956 Scarborough ..... 66/126 A
3,444,704 A * 5/1969 Smith ..... 66/125 R
3,826,110 A * 7/1974 Holder ..... 66/9 R
3,837,185 A * 9/1974 Havranek et al. ..... 66/107
3,986,371 A * 10/1976 Havranek et al. ..... 66/107
4,194,374 A * 3/1980 Guell ..... 66/93
5,010,744 A * 4/1991 Kawase et al. ..... 66/93
6,799,444 B1 * 10/2004 Wang ..... 66/108 R
6,840,065 B1 * 1/2005 Wang ..... 66/93

* cited by examiner

*Primary Examiner*—Danny Worrell
(74) *Attorney, Agent, or Firm*—Birch, Stewart, Kolasch & Birch, LLP

(57) ABSTRACT

A circular knitting machine provides sinkers that are moved in an inclined manner in the sinker troughs to position yarn laps and prevent the sinkers from hitting yarn feeding plates. The sinker has a nose section to hold the yarn laps at a horizontal high point to prevent the yarn laps from slipping, and has a throat section which has a horizontal first end surface and a belly section with an inclined second end surface in order to keep the knitting needles and sinkers moving smoothly during a knitting operation. The yarn feeding plate has a dodging edge on a distal end, the dodging edge being formed in a shape corresponding to the movement track of the sinker and having a slanted surface at the front end thereof, so as to avoid hitting the sinker when the sinker is moved in the sinker trough in an inclined manner.

3 Claims, 14 Drawing Sheets

CIRCULAR KNITTING MACHINE

FIELD OF THE INVENTION

The present invention relates to a circular knitting machine and particularly to a circular knitting machine that has sinkers mounted in an inclined manner to position yarn laps and avoid hitting yarn feeding plates when moving in an inclined manner in sinker troughs.

BACKGROUND OF THE INVENTION

Conventional circular knitting machines generally include sinkers driven by a cam. The cam has a driving path to move the sinkers to and fro to perform a knitting operation.

The sinker is engaged with a preset driving path, as shown in FIG. 1. During a knitting operation, the lug 62 of the sinker 61 is engaged with the driving path 64 of the cam 63 so that the sinker 61 is moved according to the driving path 64, to perform knitting operation. The cam 63 is mounted horizontally on the machine deck. The sinker 61 also is mounted horizontally.

The sinker 61 is located on a sinker drum 60 which rotates at high speed during knitting operation, and the sinker 61 is driven by the driving path 64 to move reciprocally to and fro rapidly. When the sinker drum 60 rotates at high speed, the sinker 61 is moved outwards at a great centrifugal force. Hence the lug 62 of the sinker 61 does not move smoothly in the driving path 64.

To remedy the foregoing problems, Applicant has proposed an improved design that includes a sinker drum with a slanted surface so that the cams and sinkers are mounted at an inclined angle against the horizontal surface of the machine deck. The sinkers may be moved in an inclined manner in the sinker troughs of the sinker drum and therefore may be driven by the cams more smoothly.

Although the slanted installation set forth above can reduce the centrifugal force of the sinker that hits the cam and therefore increase the service life of the sinker and the cam, it creates other problems. First, with the sinker directly mounted on the sinker drum in an inclined manner, the surface for holding formed yarn laps on its throat portion is also inclined. As a result, the formed yarn laps tend to slip downwards and stretch the yarn coupled on the needle. Second, with the sinker inclined, the movement of the sinker in the sinker trough is also inclined. As a result, the sinker is prone to hit the yarn feeding plate. The circular knitting machine could therefore become inoperable. The present invention aims to improve these problems.

SUMMARY OF THE INVENTION

The object of the invention is to provide a circular knitting machine that has yarn feeding plates, each with a dodging edge and a slant surface formed thereon in order to dodge the sinker, which is being moved in an inclined manner in the sinker drum. The sinker has a throat section which has one side extended to form an inclined first end surface so that the nose section of the sinker can hold the yarn laps at a higher horizontal spot without slipping, even though the sinker is moved in an inclined manner in the sinker drum.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 3:
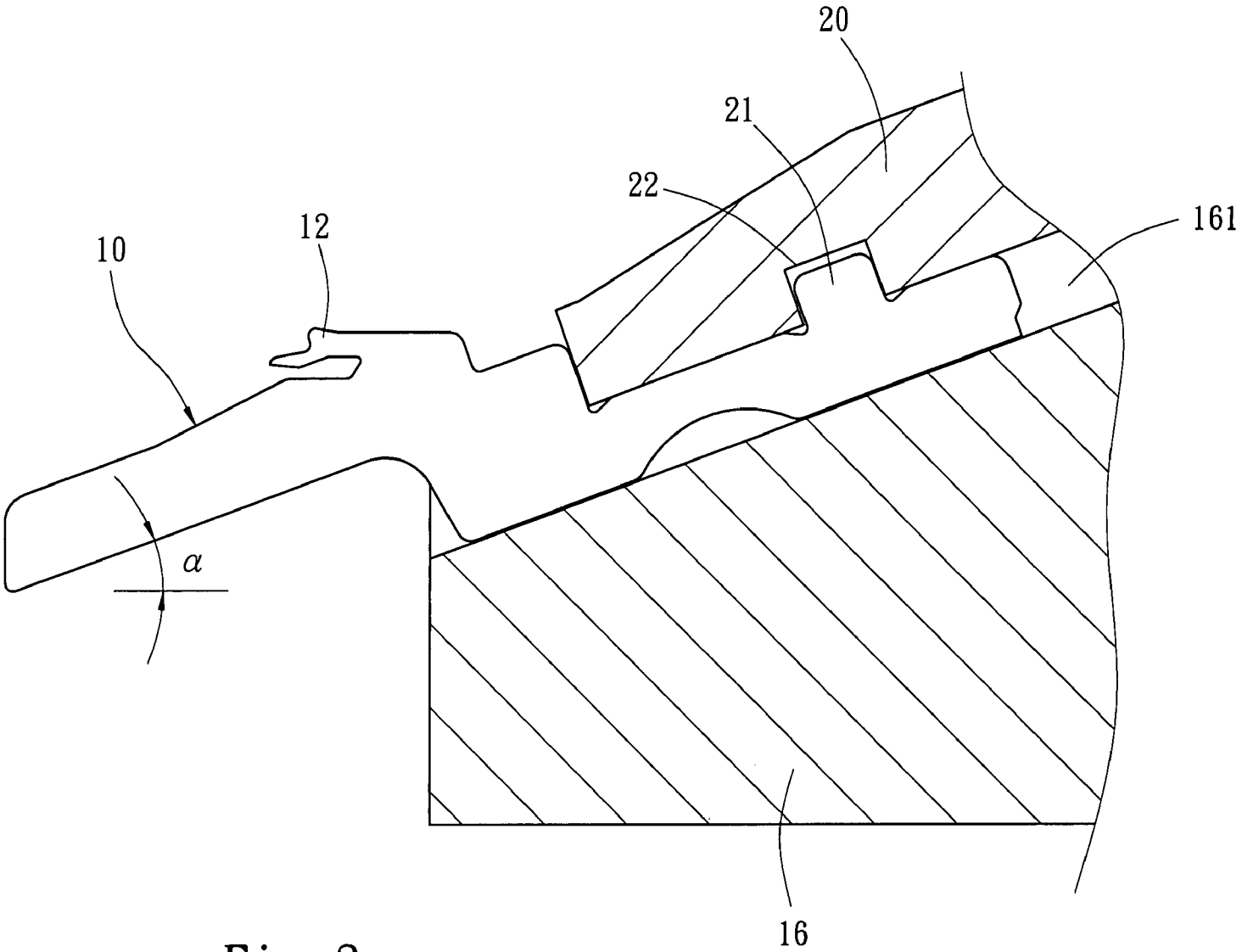
FIG. 3 is a schematic view of a cam and a sinker of the invention mounted in an inclined manner.

Referring to FIG. 3, a cam 20 is fastened to a slanted surface of a saddle plate (not shown in the drawing) mounted on a machine deck of a circular knitting machine and forms an inclined angle $\alpha$ against the horizontal surface of the machine deck. The cam 20 has a driving path 22 to allow a lug 21 of a sinker 10 to slide therein. The sinker 10 is also mounted in a slanted manner which corresponds to the cam 20.

Figure 1:
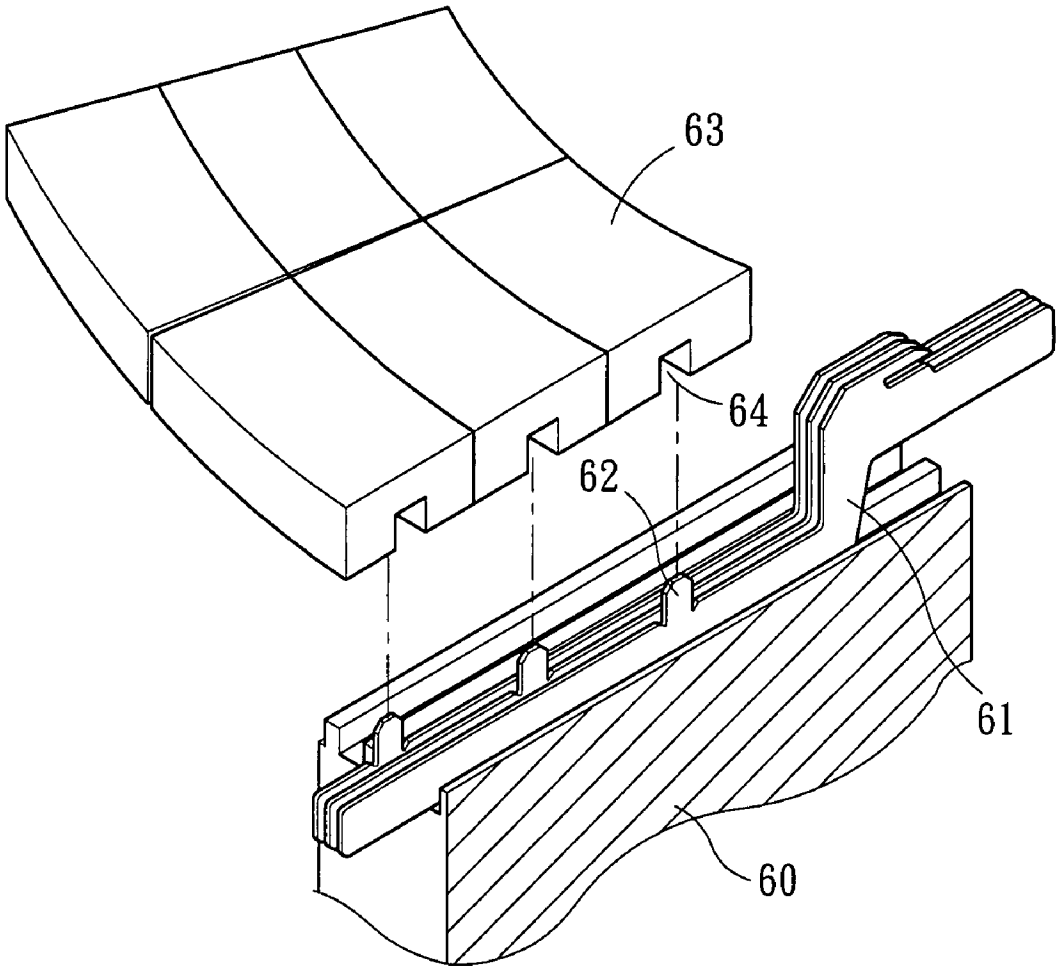
Fig. 1 PRIOR ART
FIG. 1 is a perspective view of conventional cams and sinkers mounted in a horizontal manner.
Figure 2:
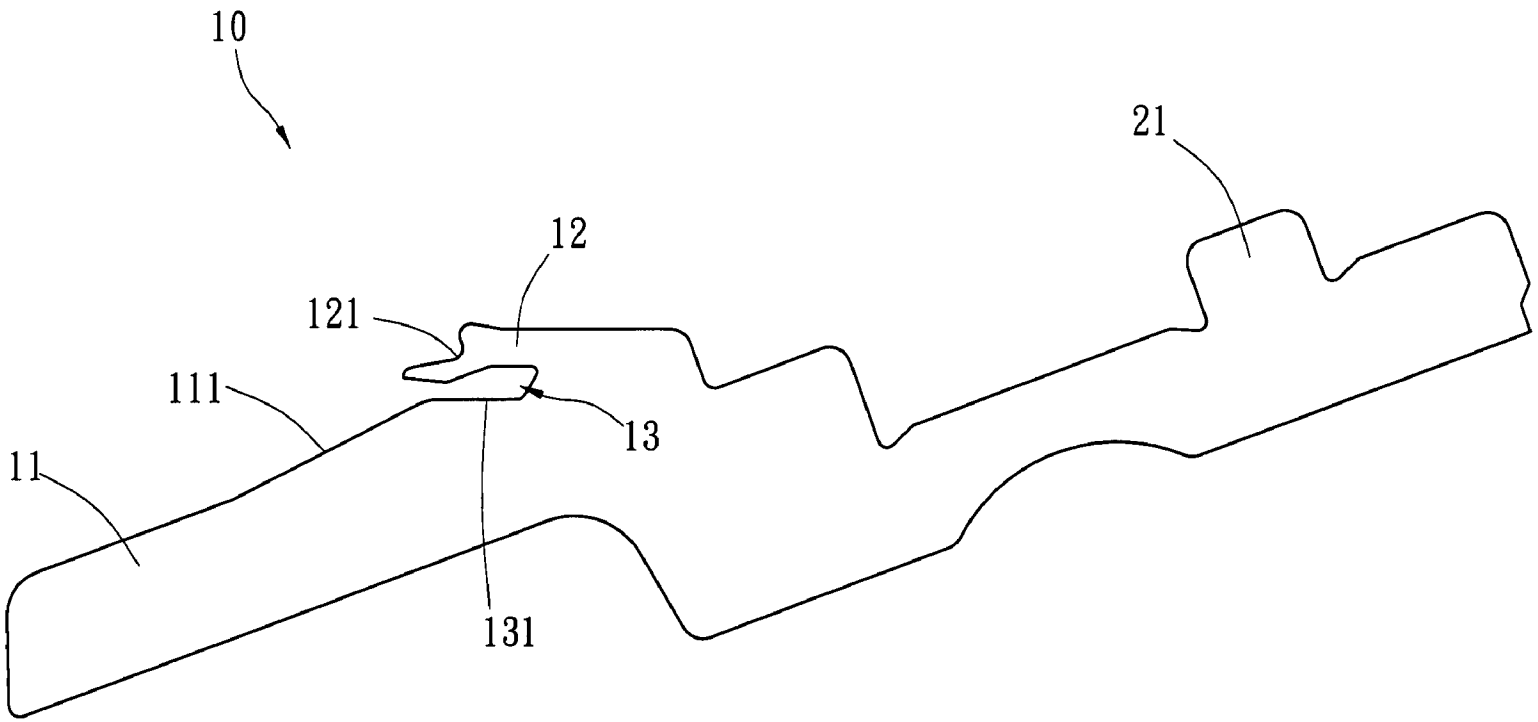
FIG. 2 is a plan view of a sinker of the invention.

Referring to FIGS. 2 and 3, the sinker 10 includes a belly section 11, a nose section 12 and a throat section 13. The throat section 13 has one end forming a first end surface 131. The belly section 11 has one end forming a second end surface 111. When the sinker 10 is moved because of the lug 21 being driven in the driving path 22 of the cam 20, the first end surface 131 is horizontal and the second end surface 111 is inclined, relative to the machine deck.

Figure 6:
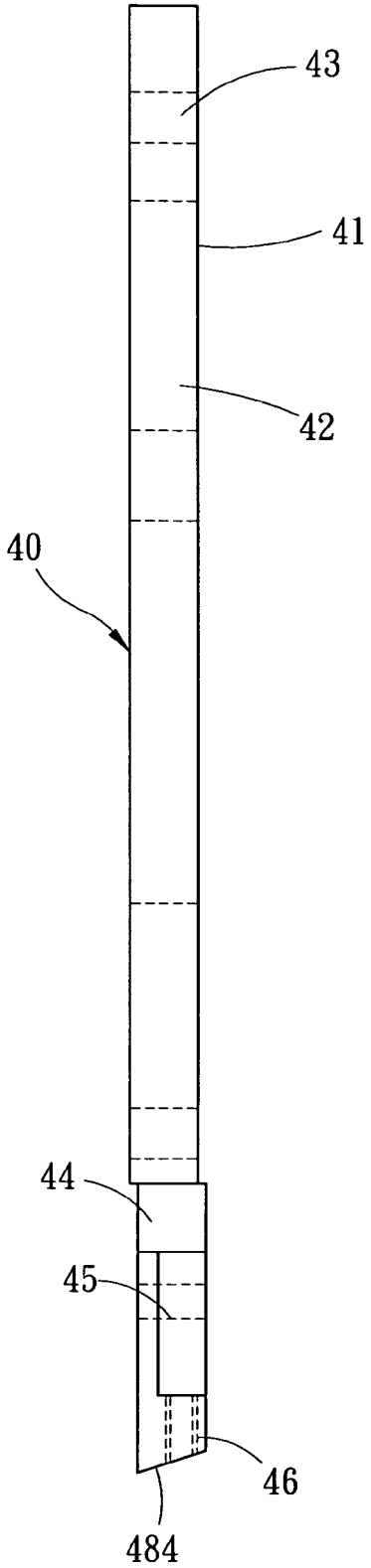
FIG. 6 is a front view of the yarn feeding plate of the invention.
Figure 7:
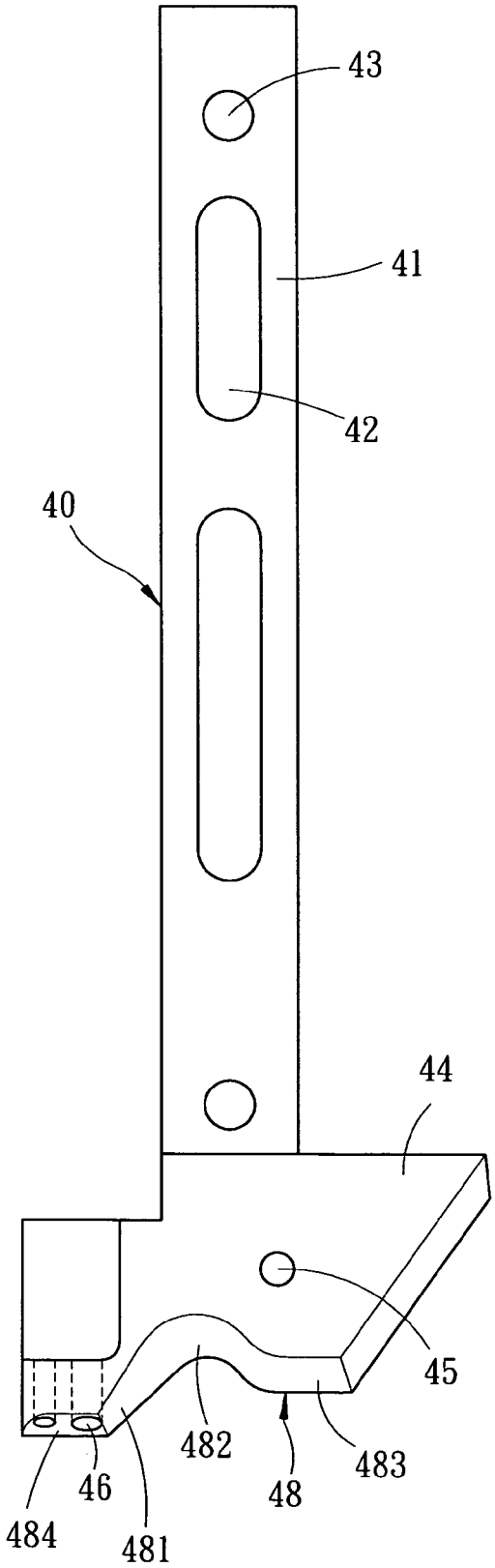
FIG. 7 is a side view of the yarn feeding plate of the invention.

Refer to FIGS. 6 and 7 for another main element of the invention.

A yarn feeding plate 40 has one end forming an elongated mounting section 41 which has two slots 42 and a screw hole 43 for fastening to the machine deck. The yarn feeding plate 40 has another end forming a polygonal yarn feeding section 44 which has a first yarn feeding port 45 and a second yarn feeding port 46, to allow knitting yarns to thread through for feeding. The yarn feeding section 44 has a dodging edge 48 on the bottom surface. The dodging edge 48 is an irregular and continuous curved surface designed according to the moving tracks of the sinker 10 in the driving path 22 of the cam 20, and aims to dodge the sinker 10. The dodging edge 48 has a slanted surface 484 at the front edge, which corresponds to inclined angle $\alpha$, to avoid hitting the sinker 10 when it is moved in the sinker drum 161 in an inclined manner.

Figure 4A:
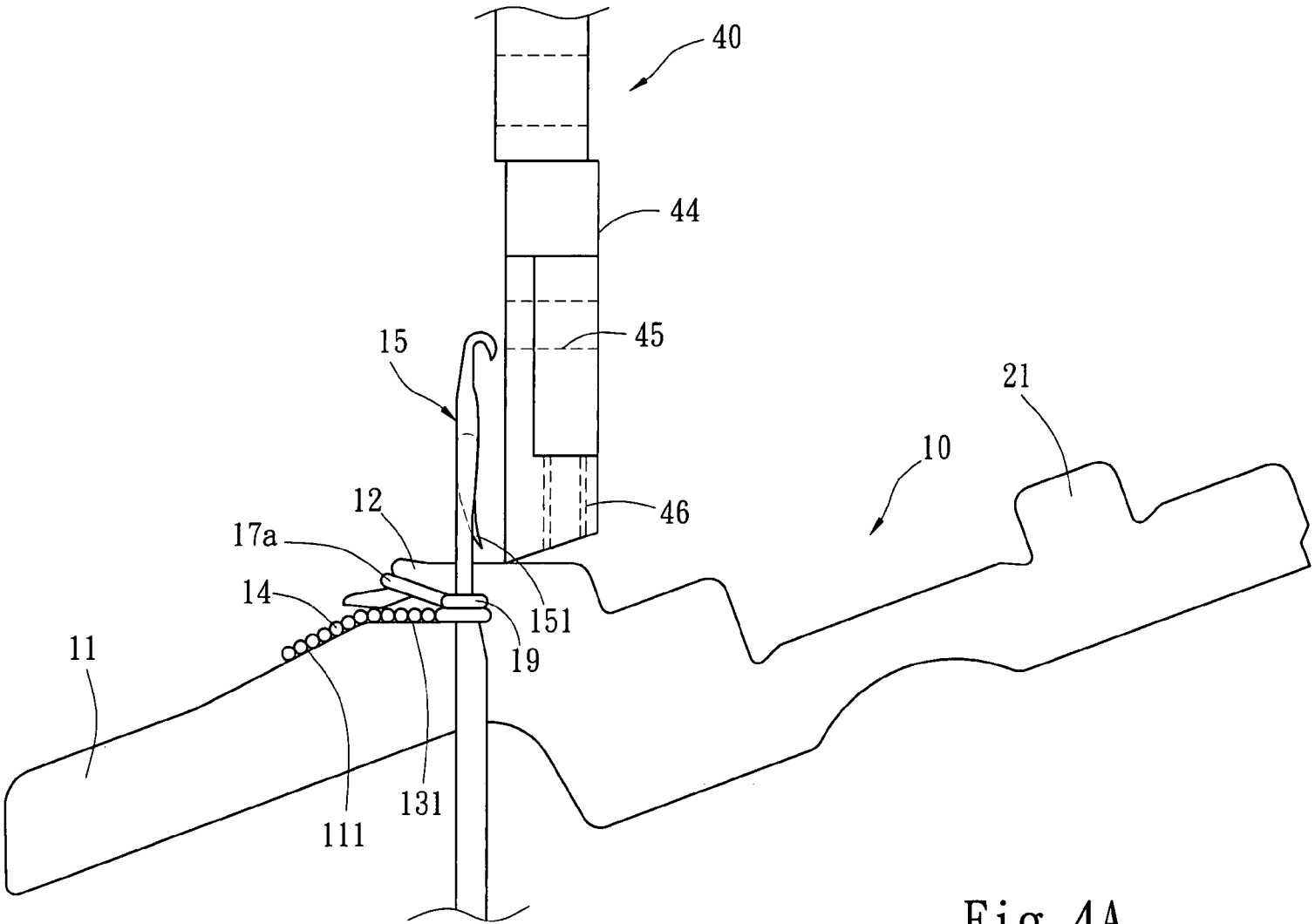
FIGS. 4A through 4G are schematic views of the invention in knitting operations.
Figure 4B:
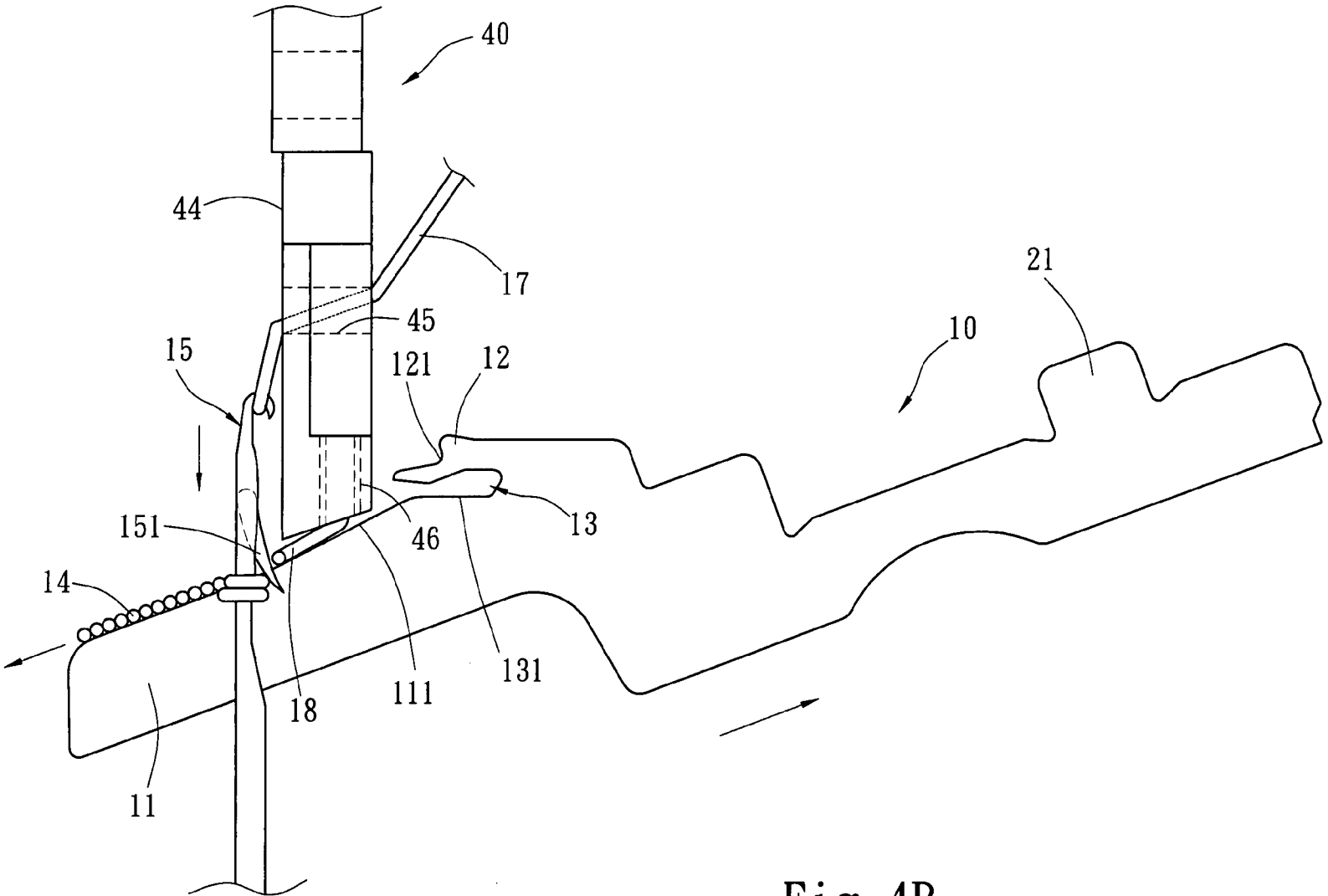

Referring to FIGS. 4A and 4B, showing the invention in use, a pile yarn 17 is threaded through the first yarn feeding port 45, and a bottom yarn 18 is threaded through the second yarn feeding port 46. With regard to the release condition of a yarn lap 17*a*, first, the sinker 10 is moved along inclined angle α towards the circular center of the circular knitting machine (not shown in the drawings) until reaching a lower dead point (referring to FIG. 4A). In the meantime, a needle 15 is lifted fully, and a tie yarn 19 is sunk to the root section of the needle 15. Next, the sinker 10 is moved rearwards along inclined angle α until reaching an upper dead point (referring to FIG. 4B). The needle 15 is lowered halfway, and the yarn lap 17*a* escapes the nose section 12 of the sinker 10 and drops onto the second end surface 111 of the belly section 11. The yarn lap 17*a* is then pulled downwards by the formed and coupled laps 14 in the front to attain a release condition. The bottom yarn 18 also drops onto the second end surface 111 of the sinker 10. In the meantime, the pile yarn 17 in the first yarn feeding port 45 is pulled downwards by the needle 15.

Figure 4C:
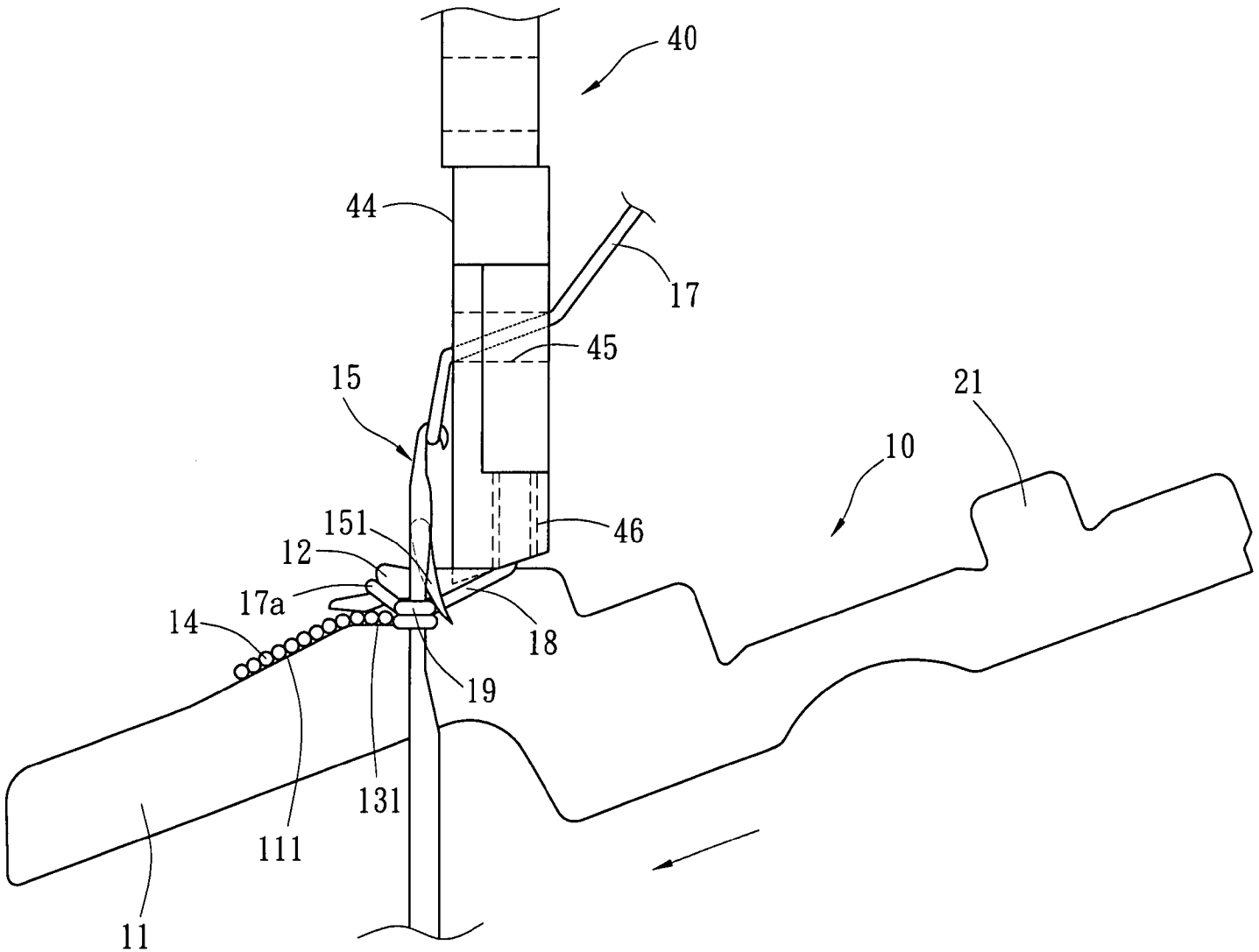
Figure 4D:
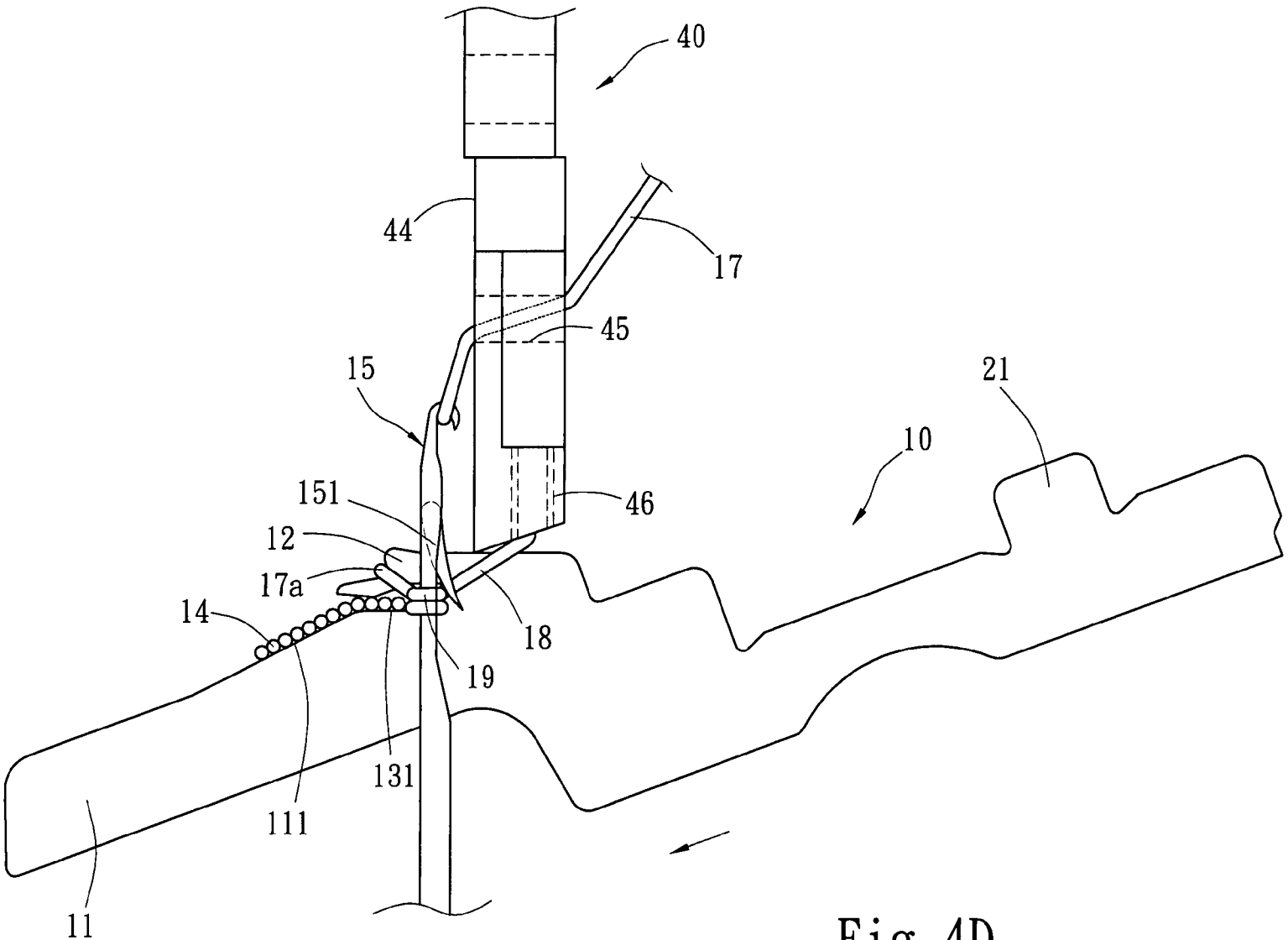

Referring to FIGS. 4C and 4D, the sinker 10 is moved slowly towards the circular center of the knitting machine (not shown in the drawings). The throat section 13 of the sinker 10 (also referring to FIG. 2) picks up the bottom yarn 18, and the first end surface 131 of the throat section 131 compresses the formed laps 14 so that they do not float and hinder knitting operation.

Figure 4E:
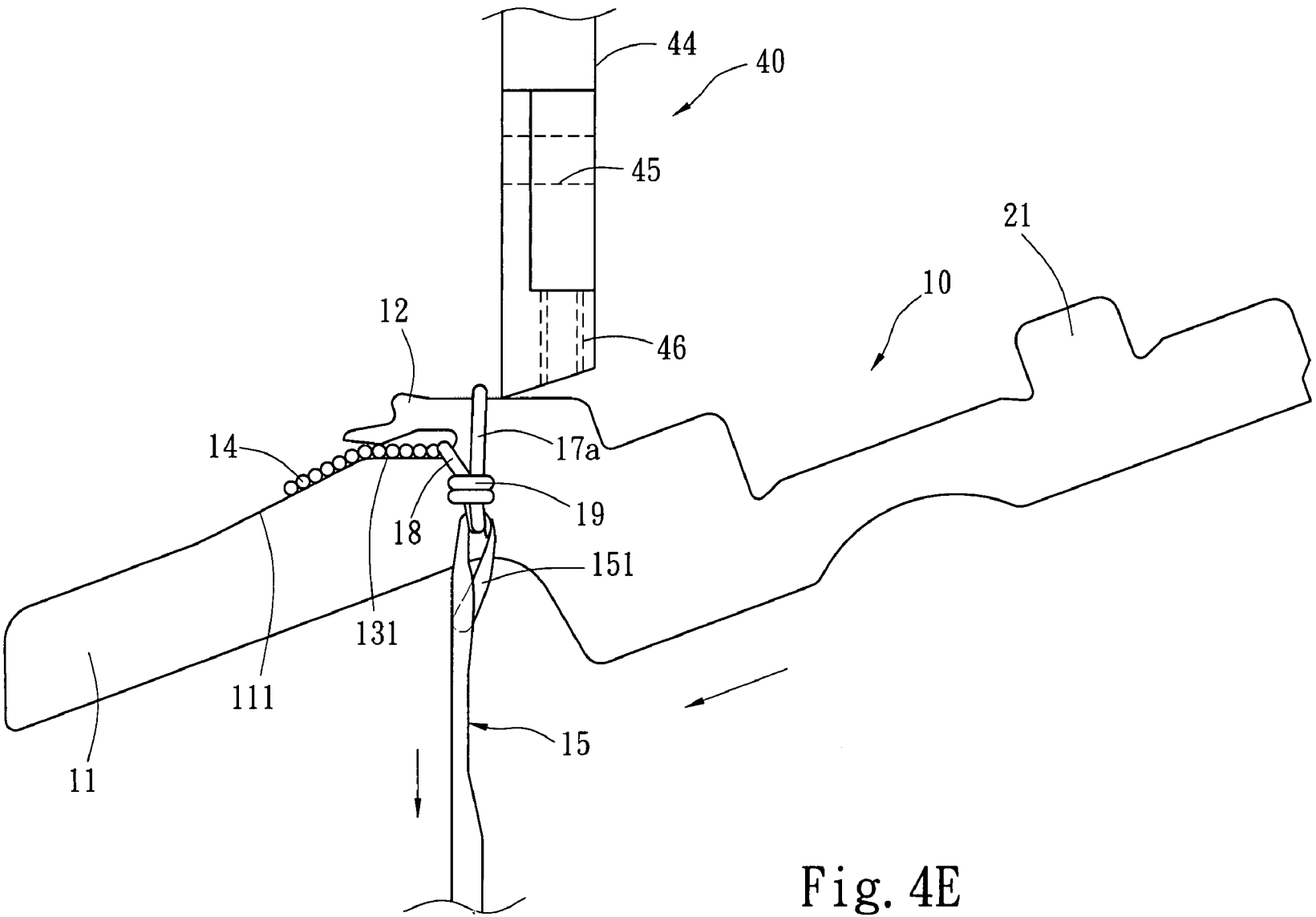

Referring to FIG. 4E, the sinker 10 is moved slightly forwards, and the needle 15 is moved downwards to the lower dead point; meanwhile the needle 15 pulls the pile yarn 17 downwards and picks up the bottom yarn 18. The tie yarn 19 is then moved upwards from the root section of the needle 15 to close the latch 151 of the needle 15, and the tie yarn 19 passes over the periphery of the needle 15 to wrap the pile yarn 17 and the bottom yarn 18 (referring to FIG. 4D). The nose section 12 holds the yarn lap 17*a* at a high horizontal location to prevent the yarn lap 17*a* from slipping down. Thus, the needle withdrawing and lap forming process is completed.

Figure 4F:
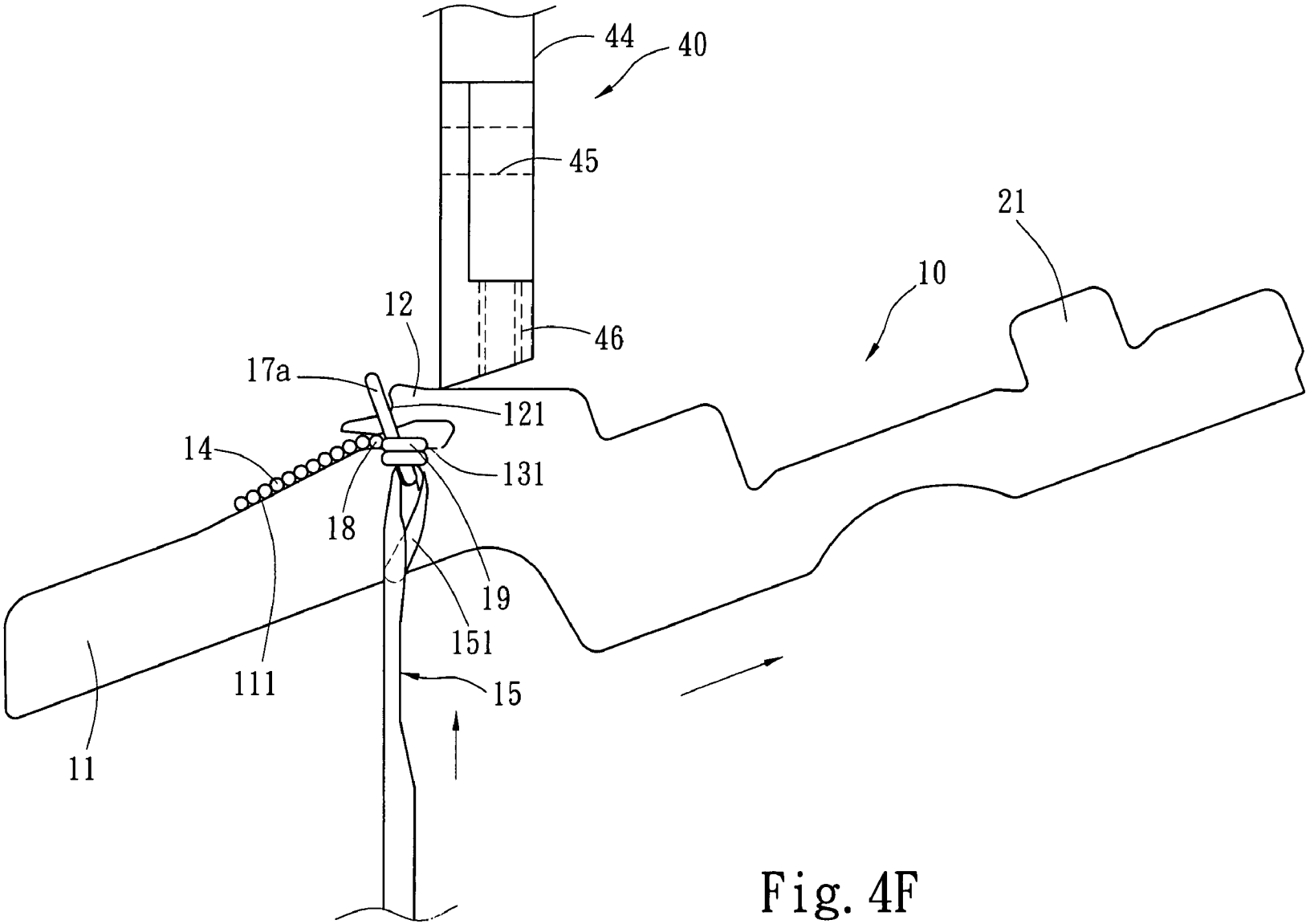
Figure 4G:
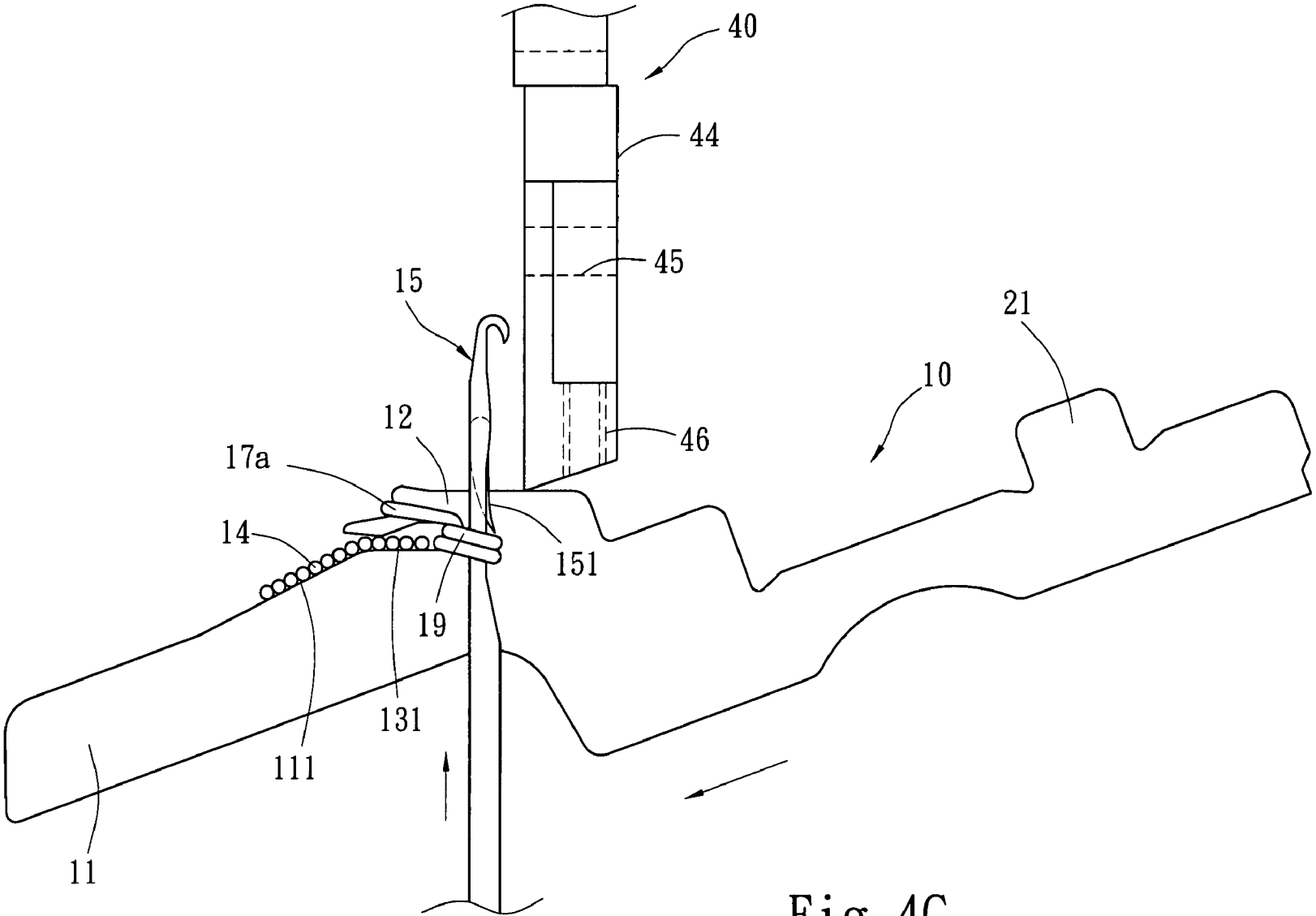

Referring to FIGS. 4F and 4G, the sinker 10 is moved rearwards slightly (in a direction shown by the arrow), and the needle 15 is lifted slightly to slightly loosen the yarn lap 17*a*. Meanwhile, the yarn lap 17*a* drops from the top end of the nose section 12 to a bracing point 121. Finally, the needle 15 is lifted, and the sinker 10 is moved forwards to lift the yarn lap 17*a*, and the tie yarn 19 drops to the root section of the needle 15. The knitting operation is thereby completed. The processes set forth above may be repeatedly performed to knit a single-face counter-wrapped pile fabric.

The operation of the yarn feeding plate 40 and the sinker 10 is elaborated as follows.

Figure 5:
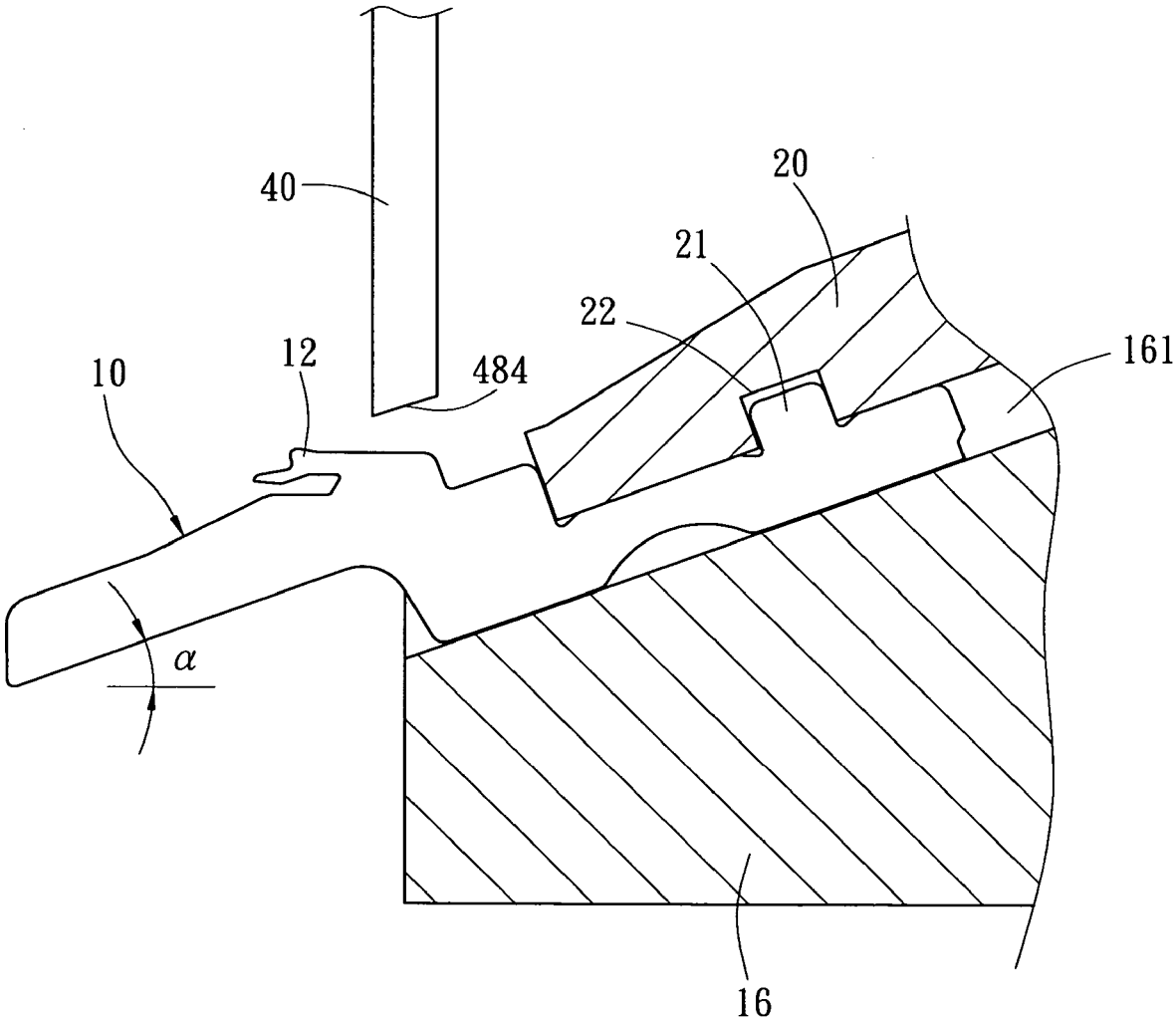
FIG. 5 is a schematic view of the invention showing the inclined installation without generating interference with the yarn feeding plate.

Referring to FIG. 5, the dodging edge 48 (see FIG. 7) on the distal end of the yarn feeding plate 40 is formed in a shape according to the movement track of the sinker 10 in the driving path 22 of the cam 20. The slanted surface 484 on the front side of the dodge edge 48 corresponds to the slanted surface of the sinker 10, and is formed to avoid hitting the sinker 10 when it is moved along inclined angle α in the sinker trough 161.

The dodging edge 48 is formed in an irregular and continuous curved surface as previously mentioned, and includes a first position 481, a second position 482 and a third position 483. The movement relationship of the yarn feeding plate 40 and the sinker 10 is elaborated as follows.

First, the sinker 10 is mounted on a sinker drum 16 which is located on an inner annular ring of the circular knitting machine. The sinker 10 is formed in the shape of a conical and shallow tray. The sinker drum 16 has sinker troughs 161 formed on the perimeter in an equally spaced fashion, which house the sinkers 10. The sinker drum 16 is rotated at high speed during knitting operation, to drive the sinker 10 to turn at high speed.

Figure 8:
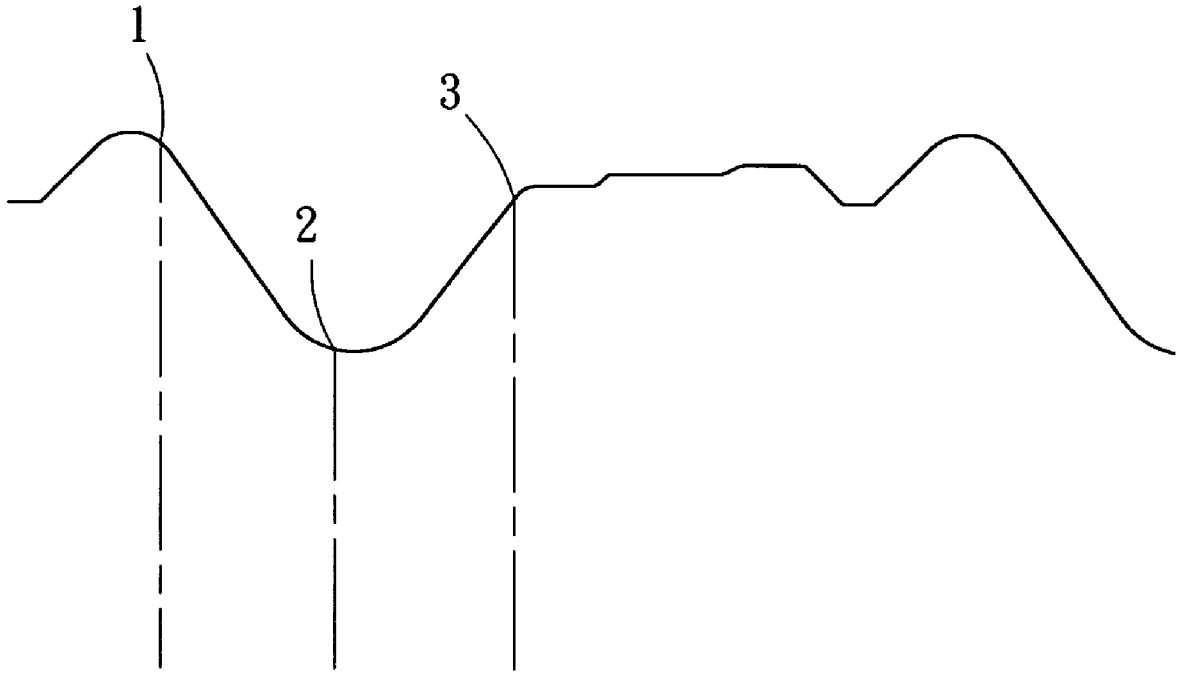
FIG. 8 is a time sequence chart of the sinker moving to and fro according to the invention.

In addition, while the sinker 10 is turning, it also is driven by the driving path 22 of the cam 20 and moved to and fro reciprocally. The movement track of the sinker 10 is determined by the driving path 22 as shown in FIG. 8, which illustrates the track according to a time sequence. The irregular and continuous curved surface of the dodging edge 48 of the yarn feeding plate 40 is determined by the movement track of the sinker 10. Because the sinker 10 is mounted in along inclined angle α, turned continuously, and moved reciprocally, it is prone to interfere with the yarn feeding plate 40. The dodging edge 48 of the yarn feeding plate 40 aims to match the movement track of the sinker 10 to prevent such interference.

Figure 9A:
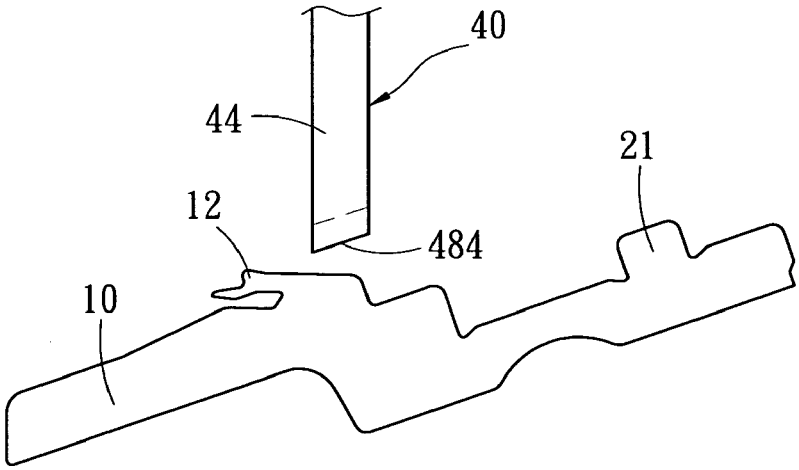
FIGS. 9A, 9B and 9C are movement relationships between the sinker and yarn feeding plate.

Refer to FIGS. 9A through 9C, and FIGS. 7 and 8 for the sinker 10 in movement conditions. Referring to FIG. 9A, the sinker 10 is located at the foremost end (i.e. first point 1 in the time sequence chart shown in FIG. 8). When the sinker 10 is driven and moved along the driving path 22 to the foremost position, the yarn feeding plate 40 has a matching concave surface of the first position 481.

Figure 9B:
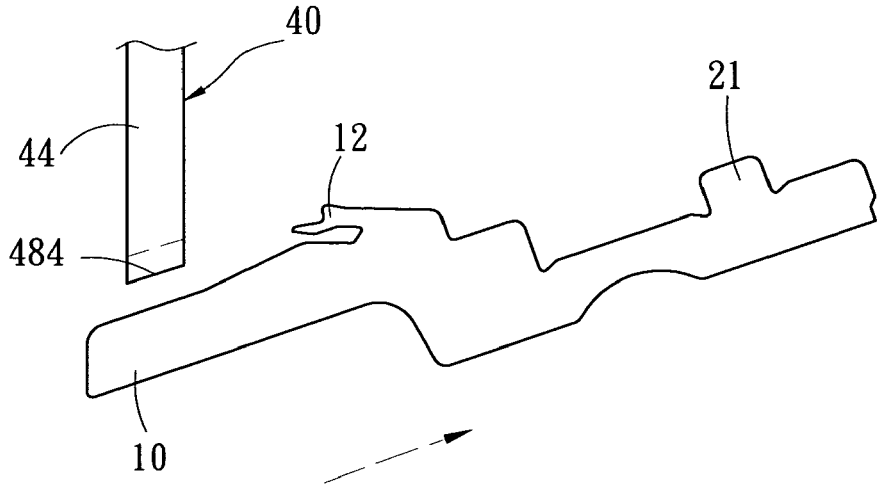

Referring to FIG. 9B, the sinker 10 is driven by the driving path 22 and moved backwards (in the direction shown by the arrow, at second point 2 in the time sequence chart in FIG. 8) until reaching to the rearmost position, whereby the sinker 10 is at the lowest point and the yarn feeding plate 40 is at the second position 482. The irregular and continuous curved surface of the dodging edge 48 has a track which corresponds to the one from the first point 1 to the second point 2 in the time sequence chart. Therefore, the dodging edge 48 can avoid hitting the sinker 10 during the to and fro movement of the sinker 10, and prevent interference with the yarn feeding plate 40.

Figure 9C:
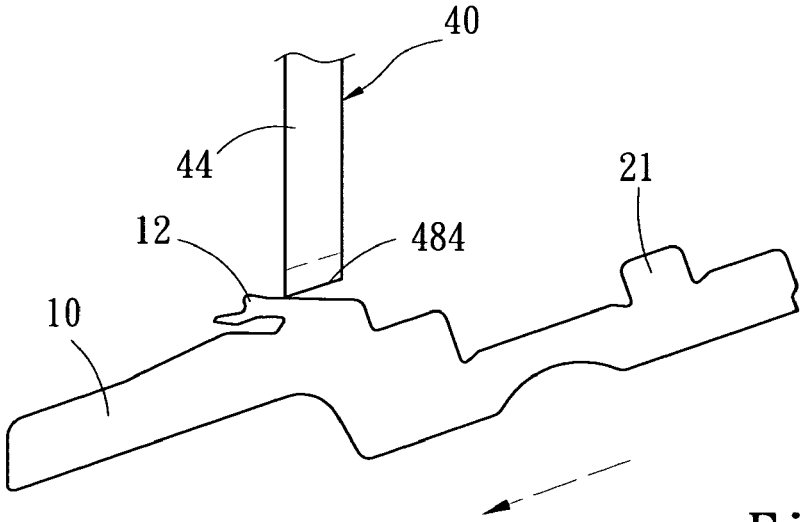

Referring to FIG. 9C, the driving path 22 drives the sinker 10 to move forwards along incline angle α (also indicated by the arrow direction), wherein the third position 483 of the dodging edge 48 can dodge the sinker 10, and the irregular and continuous curved surface of the dodging edge 48 has a track corresponding to the one moving to the third point 3 in the time sequence chart. Therefore, the dodging edge 48 can avoid hitting the sinker 10 during the to and fro movement and prevent interference with the yarn feeding plate 40. Thus, the shape of the dodging edge 48 of the yarn feeding plate 40 is formed according to the movement track of the sinker 10. In addition, the entire irregular and continuous curved surface of the dodging edge 48 also forms an inclined surface 484 at the distal end, which corresponds to the slanted installation of the sinker 10 on the sinker drum 16. The continuous rotation of the sinker 10, which is also moved along inclined angle α in the sinker trough 161, does not hit the inclined surface 484 at the front end of the dodging edge 48.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A circular knitting machine comprising sinkers mounted in an inclined manner relative to a horizontal surface of a deck of the machine and movable in sinker troughs, for positioning yarn laps and yarn feeding plates without being hit by the sinkers, wherein:

each of the sinkers has a nose section, a throat section having one end forming a first end surface which is connected to one end of the nose section, and a belly section having a second end surface which is connected to another end of the throat section, wherein the first end surface is horizontal when the sinker is mounted in the sinker trough in the inclined manner for holding the yarn laps at a horizontal high spot through the nose section, and wherein the second end surface is inclined relative to the horizontal surface of the deck of the machine; and the yarn feeding plate has a dodging edge, the dodging edge being formed on one distal end in a shape which corresponds to a movement track of the sinker, and having a slanted surface on a front end to avoid hitting the sinker during movement of the sinker in the sinker trough.

2. The circular knitting machine of claim 1, wherein the dodging edge is an irregular and continuous curve surface.

3. The circular knitting machine of claim 1, wherein the nose section has a bracing point for positioning the yarn laps.

* * * * *